United States Patent [19]

Rogerson

[11] Patent Number: 4,754,691

[45] Date of Patent: Jul. 5, 1988

[54] FLUID OPERATED DEVICES FOR MOVING ARTICLES

[75] Inventor: Victor Rogerson, Lytham St. Annes, England

[73] Assignee: British Nuclear Fuels plc, Warrington, England

[21] Appl. No.: 773,817

[22] Filed: Sep. 9, 1985

[30] Foreign Application Priority Data

Sep. 27, 1984 [GB] United Kingdom ..... 8424399

[51] Int. Cl.[4] ..... F01L 25/08

[52] U.S. Cl. ..... 91/275; 91/248; 91/410; 91/DIG. 4; 92/5 R

[58] Field of Search ..... 91/219, 248, 275, 303, 91/410, DIG. 4, 363 A; 92/5 R

[56] References Cited

U.S. PATENT DOCUMENTS 3,434,283 3/1969 Piret ..... 91/275
3,489,063 1/1970 Piret ..... 91/275
3,763,744 10/1973 Fournell ..... 91/363 R
3,779,401 12/1973 Carroll ..... 91/DIG. 4
4,002,103 1/1977 Martin ..... 91/219
4,488,477 12/1984 Miyamoto ..... 91/DIG. 4

*Primary Examiner*—Abraham Hershkovitz
*Attorney, Agent, or Firm*—William R. Hinds

[57] ABSTRACT

A fluid pressure operated device comprises a body adapted for moving an article and carrying magnets coupled to other magnets on a piston movable by fluid pressure in a cylinder. The body also carries spaced magnets and another piston carries spaced magnets. In a start position, one of said body magnets and one of said piston magnets are coupled. During normal operation the body and pistons move to another position in which the one body magnet operates a return sensor to return the device to start position. If an obstacle is encountered, the piston moves to release another sensor to reverse the device for a short stroke where a timer again reverses the fluid pressure to complete the stroke. Engagement with a second obstacle or a repeat engagement with the first obstacle returns the device to the start position and a warning alerts an operator to remove the obstruction.

2 Claims, 3 Drawing Sheets

FLUID OPERATED DEVICES FOR MOVING ARTICLES

This invention relates to fluid operated devices for moving articles.

Generally in accordance with the present invention, a fluid operated device for moving articles comprises a cylinder, a piston movable in the cylinder, the piston comprising a magnet, means for supplying pressure fluid to the cylinder to move the piston in one direction, a body outside the cylinder, the body comprising a further magnet, the further magnet being cooperable with the magnet of the piston so that the body moves with the piston, means for relieving fluid pressure from the piston on engagement of the body with an obstacle, means for reversing the pressure supply to the cylinder, the means for relieving fluid pressure comprising means responsive to engagement of the body with the obstacle to operate the reversing means, and in which the responsive means comprises a further cylinder, a further piston movable in the further cylinder, the further piston comprising a magnet, and another magnet movable with the body and cooperable with the magnet of the further piston, the further piston being movable relative to the body on said engagement to operate the reversing means.

The further piston may comprise two spaced magnets and said another magnet may comprise two spaced magnets movable with the body, only one of the spaced magnets of the further piston being normally magnetically coupled to only one of the two spaced magnets of the body, the further piston on said engagement moving to bring the two magnets of the further piston respectively into magnetic coupling relationship with the two spaced magnets of the body.

The invention may be performed in various ways and one specific embodiment with possible modifications will now be described by way of example with reference to the accompanying drawings, in which.

Figure 1:
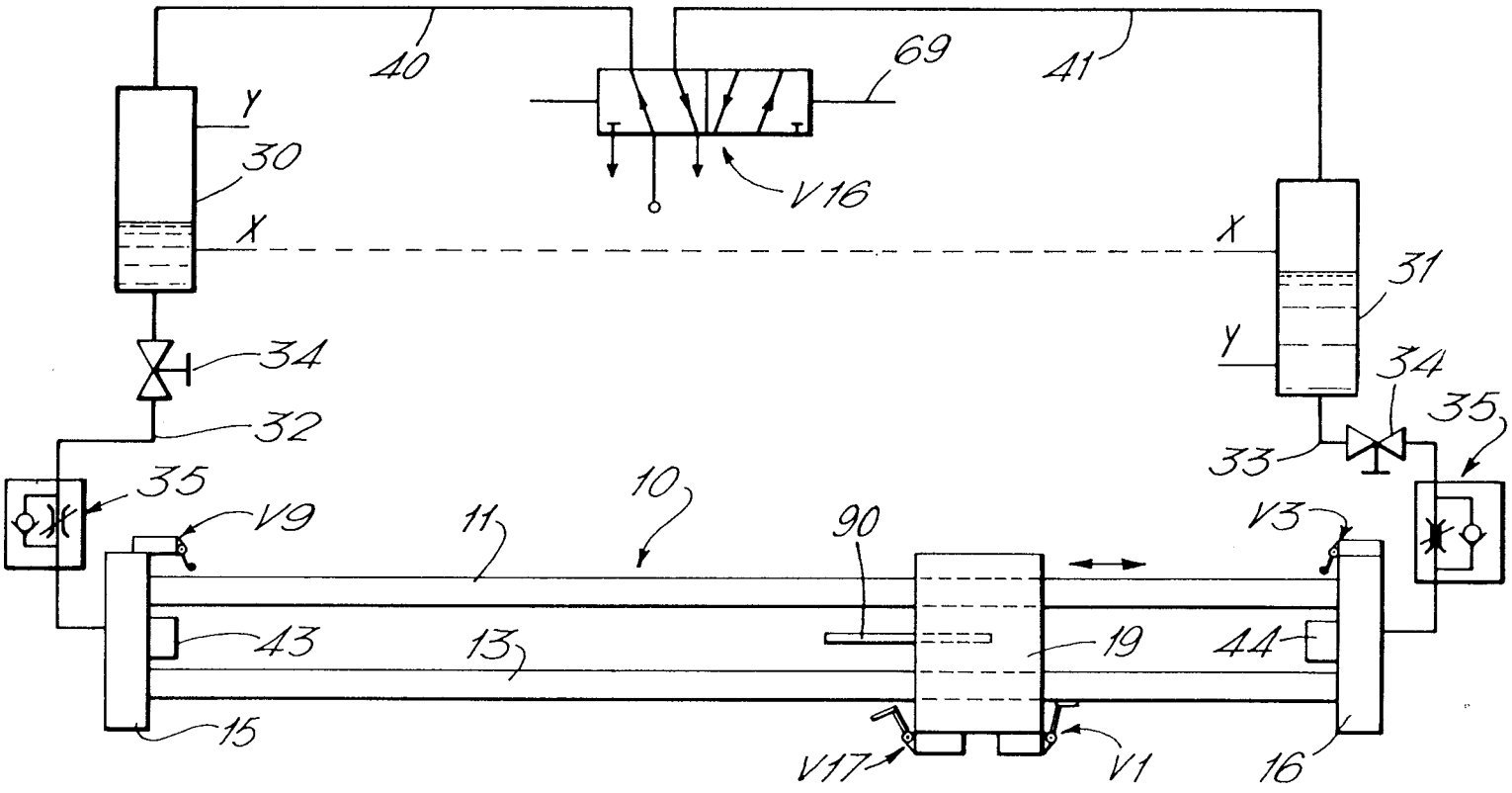
FIG. 1 is a general view of apparatus for moving an article.

Referring to FIG. 1 the apparatus 10 includes a control cylinder 11 in whch is reciprocable a piston 12, and a parallel sensor cylinder 13 in which is reciprocable a piston 14. The cylinders 11, 13 at their ends connect with manifolds 15, 16 through passages 17, 18. A carriage 19 is movable to and fro along the cylinders 11, 13. The piston 12 includes eight permanent magnets with nine pole pieces 21 and these are cooperable with eight annular permanent magnets and nine annular pole pieces 22 mounted on the carriage 19 and around the cylinder 11.

The piston 14 includes four permanent magnets with three pole pieces separated into two pairs 25, 26 by spacer 27 and fixed to the carriage are two further pairs 28, 29 of annular permanent magnets with annular pole pieces and spacer 27*a*. The length of each of spacers 27, 27*a* equals for example the axial length of four magnets with three pole pieces.

Thus when the pistons 12, 14 are moved under oil pressure, the carriage 19 moves with the pistons by virtue of the magnetic coupling between magnets 21 and magnets 22 and between magnets 25, 26 and magnets 28, 29. The cylinders 11, 13 are supplied with oil via high and low air/oil vessels 30, 31 in which the oil levels are the same (level x) when the carriage 19 is at a start (extreme right) position as shown at A in FIG. 2. The range of movement of the oil level in the two cylinders is between levels x and y. The vessels 30, 31 respectively connect with manifolds 15, 16 through lines 32, 33 which contain manually operable valves 34, which may be closed to isolate the cylinders during maintenance, and one-way speed control valves 35.

The vessels 30, 31 are supplied with pressure air respectively in lines 40, 41 via valve V16 referred to later.

End stops 43, 44 limit the movement of the carriage 19.

The pistons 12, 14 carry respectively end cushions 45, 45*a* and 46, 46*a*. The cushions 45, 45*a*, 46, 46*a* are axially adjustable to vary the effective lengths of the pistons.

Start position sensor V3 and end of stroke sensor V9 are mounted adjacent the control cylinder 11 for cooperation with the carriage 19. The carriage 19 carries rear and forward sensors V1 and V17. Sensors V1, V3, V9 and V17 carry operating levers V1*a*, V3*a*, V9*a* and V17*a*.

Figure 2:
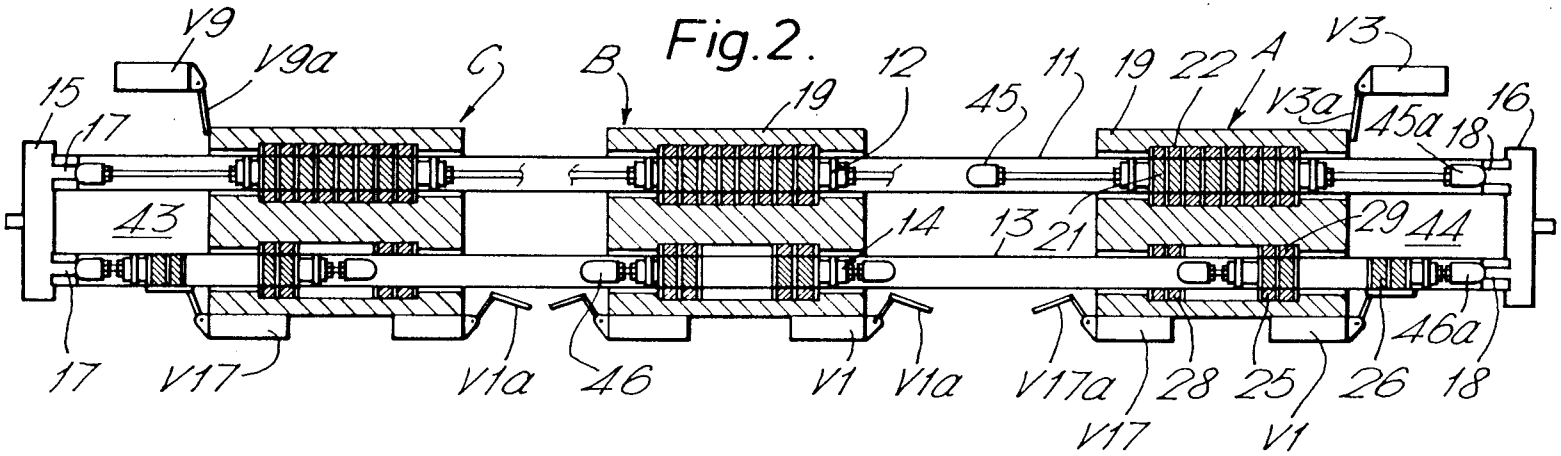
FIG. 2 shows the apparatus with a magnet arrangement in various positions.
Figure 4:
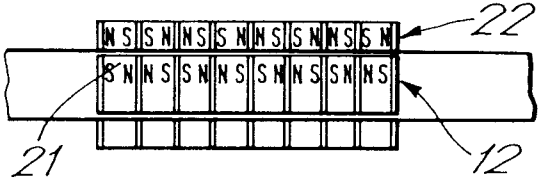
FIG. 4 shows another magnet arrangement.
Figure 3:
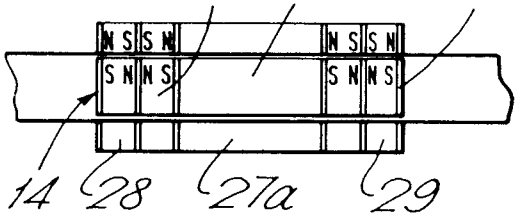
FIG. 3 shows a magnet arrangement.
Figure 5:
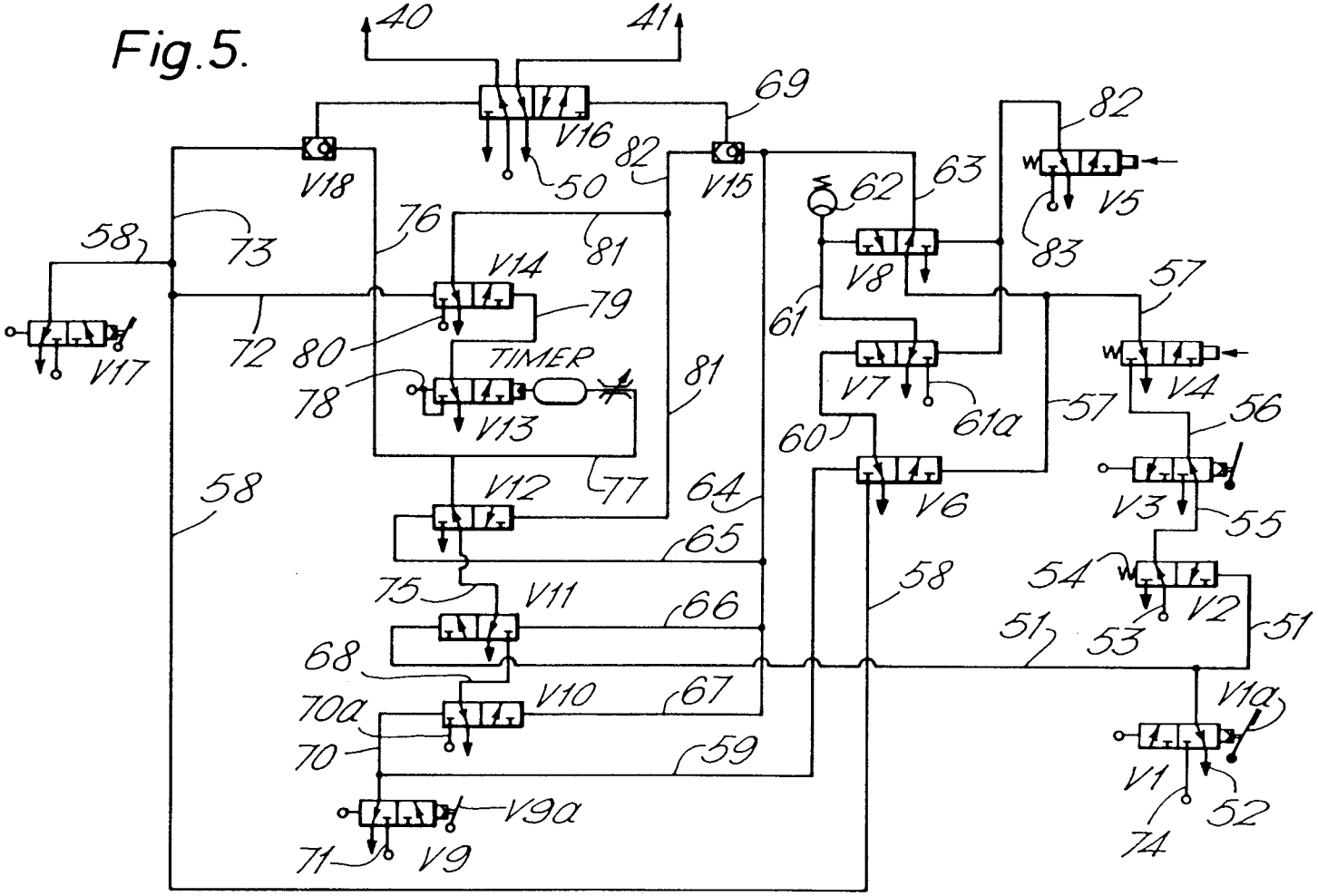
FIG. 5 illustrates a pneumatic circuit.

At a start position A FIG. 2 the carriage 19 abuts stop 44; lever V3*a* is operated by carriage 19 and magnet leverl V1*a* is operated by the magnet coupling with magnets 26. Magnets 21, 22 are fully magnetically coupled and the pair of magnets 25 is coupled to the respective pair 29; magnets 28 are not coupled.

DESCRIPTION OF PNEUMATIC CONTROL SYSTEM

It is assumed that a normal cycle has been performed or that the reset button (referred to later) has been pressed resulting in the conditions shown in FIG. 2, and that the mechanism is in the 'start' condition as shown in FIG. 2 at A. The valves in the penumatic circuit are spool valves (except valves V15, 18 which are shuttle valves).

In this condition, compressed air is admitted via valve V16 to the air/oil vessel 30 on the 'retract' side, whilst that from the 'advance' side is exhausted to atmosphere at 50. This condition results in an oil pressure, equal to the air pressure, causing a force on the internal pistons, forcing them to the 'start' condition.

In the 'start' condition, the rear magnetic sensor V1 and the start position sensor V3 are both in operated condition. Thus line 51 connecting valve V1 and valves V2 and V11 is connected to exhaust at 52 and no signal is transmitted to the pilots of valves V2 and V11. In the case of valve V2, the spring 54 return feature of the valve causes it to be conditioned such that the pressure air supply at 53 is allowed to pass through V2 via line 55 to V3. Thus, the start position sensor V3, being in its operated condition, allows the signal to proceed to valve V4 via line 56.

The start valve V4 may be manual (eg push button); or automatic, eg as part of a machine sequence. It is shown here as a manual push button valve. When operated to connect lines 56 and 57, the input signal on line 56 is allowed to proceed on line 57 piloting valve V6, to connect line 58 to line 60, and supplying an input to valve V8. The function of valve V6 is such that if a signal from the forward magnetic sensor V17 is received via line 58 before a signal from the end of stroke sensor V9 on line 59 the signal from sensor V17 is allowed through V6 to operate valve V7 via line 60 and thus connect pressure air 61*a* to line 61 to activate a warning device 62 or effect a stoppage of the machine. However if the signal from sensor valve V9 is received at valve V6 before a signal on line 58, the warning feature is inhibited because valve V6 does not change over so that valve V7 also does not change over and 61 is not connected to pressure. The signal from valve V4 passes through valve V8 to line 63 and results in the following:

a. holds valve V12 in the position shown via lines 64, 65.

b. holds valve V11 in the position shown via lines 64, 66.

c. operates valve V10 via line 67, allowing an input pressure signal from pressure 70*a* to be supplied to valve V11 via line 68.

d. via the shuttle valve V15 and line 69 applies a pilot signal to the main flow valve V16, changing its condition, venting the supply previously applied on the 'retract' side 40 and applying a pressure on the 'advance' side 41. This causes the force on the front side (left in FIG. 2) of the pistons in the mechanism to be removed, and replaced by a force on the rear side, resulting in movement of the pistons to the left, the speed of movement being regulated by the one-way speed control valves 35. The movement of the pistons causes a like movement in the outer carriage 19, the extent of the available effort being limited to the magnetic coupling of the forward piston magnets 21, 25 with respectively the carriage magnets 22 and 29.

When the carriage 19 starts to move, it loses contact with the start position sensor V3, inhibiting any further start signal until V3 is re-engaged. The pilot signal applied to V16 is therefore vented. The rear magnetic sensor V1 remains operated through magnetic coupling with magnet 26.

In normal operation, the movement of the pistons and carriage proceeds until the carriage reaches the end-of-stroke sensor V9.

Sensors V1, V17, have magnetic pivoted operating arms V1*a*, V17*a* respectively. Sensors V3, V9 are mechanical with operating arms V3*a*, V9*a*.

The operation of V9 transmits a pilot signal from source 71 to V10 via line 70 and to V6 via line 59. In the case of V10, operation of V10 isolates the supply 70*a* and vents the signal previously transmitted to V11. In the case of V6, operation of V6 isolates any possible supply signal from V17 via line 58.

When the outer carriage 19 reaches its mechanical stop V9*a*, the inner piston 14 continues until the forward magnetic sensor is reached so as to magnetically couple 26 and 28 (end-of-stroke condition, C FIG. 2). This sensor V17 is operated to transmit signals to V6 via line 58, to V14 via line 72 and to V18 via line 73. At V6, the valve had already been piloted from V9, so the signal cannot proceed further.

At V14, the valve condition is confirmed.

At V18, which is a shuttle valve, the signal is allowed to proceed to the main valve V16, reverting it to its original condition where the 'advance' output 41 is vented, and the 'retract' output 40 pressurised, resulting in an oil flow which reverts the system to its start condition A FIG. 2.

If an obstruction is encountered, the outer carriage 19 stops but the inner piston 14 continues, thus losing the magnetic attraction which has been holding the rear magnetic sensor V1 engaged with magnet 26, and proceeding until the "as pecked" situation B (FIG. 2) is achieved with magnets 28, 25 coupled and also magnets 29, 26.

The effect of the cessation of operation of V1 is to apply pilot signals to V2 and V11 via line 51 from source 74. The pilot signal at V2 inhibits re-starting until this signal is re-applied. The pilot signal at V11 changes V11 to permit the signal from V10 on line 68 to proceed to V12 via line 75 and thence via line 76 and the shuttle valve V18 to the main valve V16, reversing the oil flow, and causing the pistons and outer carriage to retract. At the same time, the signal from V12 is applied via line 77 to a timer V13. After the expiration of a pre-set time determined by timer V13, during which time the carriage has retracted a small distance, the timer output from source 78 operates the pilot of V14 via line 79 causing:

a. pilot signal to V12 from source 80 via line 81 to change valve V12, thus cancelling the supply to the timer and the signal being transmitted via V18 to V16.

b. via V15, applying a signal to the other end of V16 via lines 82, 69 again reversing the flow, and reinstating the forward motion.

Note that now, instead of one set of magnets 25, 29 being engaged or coupled, there are two sets (25, 28 and 26, 29) coupled in piston 14 and so a greater force is available at the outer carriage for transmitting to the object to be moved.

If this greater force is sufficient to overcome the obstruction the system then proceeds as th normal operation, returning after reaching the end of stroke, and re-setting ready for the next operation.

If further obstruction is encountered, sufficient to overcome the force transmitted by the two magnetic units engaged by the first, or 'pecking' action, the inner piston 14 will break out from this attraction and proceed such that the forward magnetic sensor V17 is operated by magnetic coupling with magnets 25 before the end-of-stroke sensor V9 is operated. In this case, signals are sent to:

a. V14 cancelling its output signal, and hence venting the 'advance' pilot signal to V16, via shuttle valve V15.

b. via shuttle valve V18 to V16 reversing the flow and causing the magnet assemblies to revert to the start condition.

c. via V6, to the pilot of V7, causing a mains signal to proceed to V8, thus preventing the 'start' signal from being effective. This signal from V7 also energises a warning signal 62 (a visual indicator is shown, but this could equally or in addition be audible).

The result of these actions is that the mechanism is rendered inactive. Operator attention is drawn to the machine, and when the obstruction has been removed a signal from the push button reset valve V5 on line 82 from source 83 will reset the pilots of V7 and V8, cancelling the warning signal and reverting the machine to a condition where the start signal can be effective.

In a modification the arrangement is such that engagement of carriage 19 with an obstacle when moving in either of the two opposed directions will arrest and possibly reverse the carriage movement, as above.

The machine may be used in filling a nuclear fuel canister with fuel pellets where there is a tendency for out of squareness of pellets to produce a jam condition readily cleared by a modest force. The body 19 includes a plunger 90 for engaging pellets.

The oil levels shown in FIG. 1 correspond to the position of the carriage 19 ie. at approx. $\frac{1}{4}$ stroke. At the start position the oil levels are at x; the air/oil cylinders are located such that the x positions in the cylindersare at the same height such that during period of non-use if in time there is a leak across the pistons the gravity effect is to restore the optimum working condition.

I claim:

1. A fluid operated device for moving articles comprising a cylinder, a piston movable in the cylinder, said piston comprising a magnet, means for supplying pressure fluid to the cylinder to move the piston in one direction, a body outside the cylinder, said body comprising a further magnet, said further magnet being cooperable with said magnet of said piston so that the body moves with the piston, means for relieving fluid pressure from the piston on engagement of the body with an obstacle, means for reversing the pressure supply to the cylinder, said means for relieving fluid pressure comprising means responsive to engagement of the body with the obstacle to operate the reversing means, in which the responsive means comprises a further cylinder, a further piston movable in the further cylinder said further piston comprising a magnet, and another magnet movable with the body and cooperable with the magnet of the further piston, the further piston being movable relative to the body on said engagement to operate said reversing means.

2. A device as claimed in claim 1, in which the further piston comprises two spaced magnets and said another magnet comprises two spaced mangets moveable with the body, only one of said spaced magnets of said further piston being normally magnetically coupled to only one of said two spaced magnets of said body, said further piston on said engagement moving to bring said two magnets of said further piston respectively into magnetic coupling relationship with said two spaced magnets of said body.

* * * * *